US009620092B2

(12) United States Patent
Wong et al.

(10) Patent No.: US 9,620,092 B2
(45) Date of Patent: Apr. 11, 2017

(54) COMPOSITION USING CORRELATION BETWEEN MELODY AND LYRICS

(71) Applicant: The Hong Kong University of Science and Technology, Kowloon (HK)

(72) Inventors: Chi Wing Wong, New Territories (HK); Raymond Ka Wai Sze, Chai Wan (HK); Cheng Long, Hunan Province (CN)

(73) Assignee: THE HONG KONG UNIVERSITY OF SCIENCE AND TECHNOLOGY, Kowloon (HK)

( * ) Notice: Subject to any disclaimer, the term of this patent is extended or adjusted under 35 U.S.C. 154(b) by 0 days.

(21) Appl. No.: 14/095,019

(22) Filed: Dec. 3, 2013

(65) Prior Publication Data

US 2014/0174279 A1 Jun. 26, 2014

Related U.S. Application Data

(60) Provisional application No. 61/848,028, filed on Dec. 21, 2012.

(51) Int. Cl.
*G04B 13/00* (2006.01)
*G10H 1/00* (2006.01)

(52) U.S. Cl.
CPC ..... *G10H 1/0025* (2013.01); *G10H 2210/145* (2013.01); *G10H 2220/011* (2013.01); *G10H 2240/131* (2013.01)

(58) Field of Classification Search
USPC ..... 84/609
See application file for complete search history.

(56) References Cited

U.S. PATENT DOCUMENTS 5,517,892 A * 5/1996 Fujimori ..... 84/462
5,736,663 A * 4/1998 Aoki ..... G10H 1/0025 84/609
6,075,193 A * 6/2000 Aoki ..... G10H 1/0025 84/609
6,191,349 B1 * 2/2001 Flam ..... G10H 1/0066 84/609

(Continued)

FOREIGN PATENT DOCUMENTS

EP 0 566 232 A2 10/1993
WO 96/10248 A1 4/1996

(Continued)

OTHER PUBLICATIONS

Gerhard Nierhaus. "Algorithmic Composition: Paradigms of Automated Music Generation." SpringerWienNewYork. 2009.

(Continued)

*Primary Examiner* — Christopher Uhlir
(74) *Attorney, Agent, or Firm* — Amin, Turocy & Watson, LLP

(57) ABSTRACT

Disclosed are ways to generate a melody. Currently, no algorithm exists for automatically composing a melody based on music lyrics. However, according to some recent studies, within a song, there usually exists a correlation between a song's notes and a song's lyrics wherein a melody can be generated based on such correlation. Disclosed herein, are systems, methods and algorithms that consider the correlation between a song's lyrics and a song's notes to compose a melody.

22 Claims, 8 Drawing Sheets

Fig. 3 Architecture of T-Music

(56) References Cited

U.S. PATENT DOCUMENTS

| | | | | |
|---|---|---|---|---|
| 6,689,946 | B2 * | 2/2004 | Funaki | G09B 15/04 84/477 R |
| 7,792,782 | B2 * | 9/2010 | Yun | G06Q 30/00 715/716 |
| 2001/0037721 | A1 * | 11/2001 | Hasegawa | G10H 1/0041 84/609 |
| 2004/0025671 | A1 * | 2/2004 | Mack | G10G 1/00 84/613 |
| 2005/0076772 | A1 * | 4/2005 | Gartland-Jones | G10H 1/0025 84/615 |
| 2009/0217805 | A1 * | 9/2009 | Lee | G10H 7/006 84/611 |

FOREIGN PATENT DOCUMENTS

| | | | |
|---|---|---|---|
| WO | 01/09875 | A1 | 2/2001 |
| WO | 2007066927 | A1 | 6/2007 |
| WO | 2007091938 | A1 | 8/2007 |
| WO | 2008077128 | A2 | 6/2008 |
| WO | 2009029126 | A1 | 3/2009 |
| WO | 2009107137 | A1 | 9/2009 |

OTHER PUBLICATIONS

Brooks et al. "An Experiment in Musical Composition." IRE Transactions on Electronic Computers. Sep. 1957. pp. 175-182.

Lerdahl et al. "A Generative Theory of Tonal Music." The MIT Press, Cambridge Massachusetts, 1983. pp. iii-16.

David Cope. "Experiments in Music Intelligence (EMI)." 1987 ICMC Proceedings. pp. 174-181.

Horner et al. "Genetic Algorithms and Computer-Assisted Music Composition." Urbana 51 (1991) 8 pages.

Qin et al. "Lexical Tones Learning with Automatic Music Composition System Considering Prosody of Mandarin Chinese." Second Language Studies: Acquisition, Learning, Education and Technology (2010): 3-6.

Murray Schellenberg. "Singing in a Tone Language: Shona." Selected Proceedings of the 39th Annual Conference on African Linguistics, 2009, pp. 137-144.

Michael O. Rabin. "Probabilistic Automata." Information and Control 6, Apr. 12, 1963, pp. 230-245.

Jay Ayres et al. "Sequential PAttern Mining using a Bitmap Representation." Proceedings of the eighth ACM SIGKDD international conference on Knowledge discovery and data mining, 2002, Edmonton, Alberta, Canada, pp. 429-435.

M.O. Rabin et al. "Finite Automata and Their Decision Problems." IBM Journal, Apr. 1959, pp. 114-125.

Downey, et al. "Parameterized Algorithms." Algorithms and Theory of Computation Handbook, Second Edition, 2001 by CRC Press LLC, pp. 1-29.

Mikhail J. Atallah, ed. "Algorithms and Theory of Computation Handbook." CRC Press, LLC, 1999, 1265 pages.

* cited by examiner

Tones of the word "International" (from merriam-webster dictionary)

Fig. 2. A fragment of song (Scarborough Fair)

Fig. 3. Architecture of T-Music

COMPOSITION USING CORRELATION BETWEEN MELODY AND LYRICS

CROSS REFERENCE TO RELATED APPLICATION

This application claims priority to U.S. Provisional Application No. 61/848,028, filed Dec. 21, 2012 and entitled "Automatic Algorithmic Composition by Using Correlation between Melody and Lyric", which is incorporated by reference herein in its entirety.

TECHNICAL FIELD

This disclosure relates to systems, methods, and algorithms that automatically generate a melodic composition of a song.

BACKGROUND

There are many studies that have proposed algorithms for composing the melody of a song automatically, which is known as algorithmic composition. Algorithms (or, at the very least, formal sets of rules) have been used to compose music for centuries. The term is usually reserved for the use of formal procedures to make music without human intervention, either through the introduction of chance procedures or the use of computers. While many studies have been done, various techniques have their respective limitations, and thus an improved algorithmic composition system is desired.

SUMMARY

The following presents a simplified summary of the disclosure in order to provide a basic understanding of some aspects of the disclosure. This summary is not an extensive overview of the disclosure. It is intended to neither identify key or critical elements of the disclosure nor delineate any scope of particular embodiments of the disclosure, or any scope of the claims. Its sole purpose is to present some concepts of the disclosure in a simplified form as a prelude to the more detailed description that is presented later.

In accordance with one or more embodiments and corresponding disclosure, various non-limiting aspects are described in connection with automatic algorithmic composition. In an embodiment, a method is provided comprising receiving, by a system comprising a processor from a data store, tone data determined from a set of songs represented by a set of notes and a set of song lyrics represented by a set of words, wherein the tone data is selected from the data store based at least on first correlation data that correlates the set of notes to the set of words; determining, by the system, a pattern at least based on a correlation between a subset of the songs represented by a subset of the notes and a subset of the song lyrics represented by a subset of the words; creating, by the system, a composition model based at least on the pattern; generating, by the system, a melody based at least on the composition model; and pairing, by the system, the melody at least to the subset of the song lyrics.

The method can further comprise analyzing, by the system, respective key signatures comprising respective major scales or respective minor scales of respective songs of the set of songs based at least on respective frequency distributions of respective sets of notes associated with the respective songs of the set of songs. In another aspect, the method can further comprise matching, by the system, respective musical syllable identifiers to letters representing respective notes of the set of notes. In yet another aspect, the method can further comprise assigning, by the system, respective tone data values to respective syllable segments associated with respective words of the set of words based at least on second correlation data that correlates the tone data to the syllable identifiers from the data store.

The following description and the annexed drawings set forth certain illustrative aspects of the disclosure. These aspects are indicative, however, of but a few of the various ways in which the principles of the disclosure may be employed. Other aspects of the disclosure will become apparent from the following detailed description of the disclosure when considered in conjunction with the drawings.

DETAILED DESCRIPTION

Overview

Figure 1:
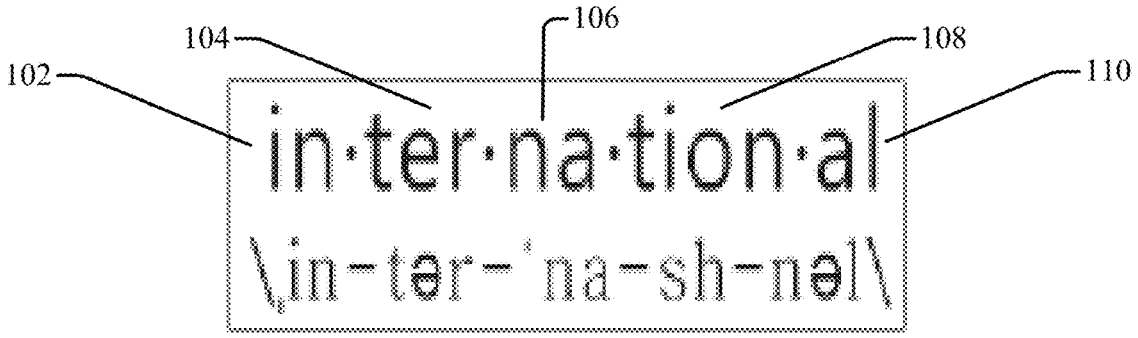
FIG. 1 illustrates a non-limiting example of syllables associated with a word and the tonal stresses associated with respective syllables.

The various embodiments are now described with reference to the drawings, wherein like reference numerals are used to refer to like elements throughout. In the following description, for purposes of explanation, numerous specific details are set forth in order to provide a thorough understanding of the various embodiments. It may be evident, however, that the various embodiments can be practiced without these specific details. In other instances, well-known structures and components are shown in block diagram form in order to facilitate describing the various embodiments.

As mentioned in the background, there have been various studies on the topic of algorithmic composition. However, none of the existing approaches take lyrics into consideration for melody composition. Yet, it has been observed that within a song, there usually exists a certain extent of correlation between its melody and its lyrics. Accordingly, various embodiments described herein utilize this type of correlation information for automatic melody composition. When a lyric is present in a song, algorithmic composition can consider not only the temporal correlation among all notes (or sounds) of the melody in the song, but also the lyric-note correlation between the notes and the lyrics in the song. A model is used to take into lyrics of existing songs and incorporate the correlation between song notes and song lyrics to generate a melody. Furthermore, a model is used to consider song patterns, tones, lyrics and songs of different languages to generate such melodies.

By way of further introduction, this disclosure relates to a method for automatically composing a musical melody by taking into consideration correlations and relationships between a song melody and lyric.

When a lyric is present in a song, algorithmic composition can thus consider not only the temporal correlation among the notes (or sounds) of the melody in the song but also the lyric-note correlation between the notes and the lyrics in the song. In this regard, the existing approaches to algorithmic composition do not take into account the lyric-note correlation due to the absence of lyrics in such algorithmic composition studies.

Algorithmic Composition Using a Correlation Between Melody and Lyrics

The lyric-note correlation corresponds to the correlation between the changing trend of a sequence of consecutive notes (also referred to as a set of notes) and the changing trend of a sequence of consecutive corresponding song lyrics (also referred to as a set of song lyrics) represented by a sequence of consecutive corresponding words. The changing trend of a sequence of notes corresponds to a series of pitch differences between every two adjacent notes since each note has its pitch (or its frequency). The changing trend of a sequence of words (wherein each word can be segmented into one or more syllable) corresponds to a series of tone differences between every two adjacent syllable since each syllable has its tone. For example, turning now to FIG. 1, FIG. 1 is an illustration of the English word "international", which has 5 syllables, particularly, "In" illustrated at 102, "ter" at 104, "na" at 106, "tion" at 108, and "al" at 110. In an aspect, each syllable is spoken in one of the three kinds of stresses or tones, namely the primary stress, the secondary stress and the non-stress. The primary stress is a sound associated with utterance of a syllable with a higher frequency, the secondary stress is a sound with a lower frequency and the non-stress is a sound with the lowest frequency. In FIG. 1, the third syllable (e.g., "na" at 106) corresponds to the primary stress, the first syllable corresponds to the secondary stress (e.g., "in" at 102) and each of the other syllables corresponds to the non-stress (e.g., "ter" at 104, "tion" at 108, or "al" at 110). In music, tones, which are steady periodic sounds often characterized by duration, pitch, intensity and timbre, appear in many languages in the world in addition to English. In Mandarin, there are four or five tones and each word has only one syllable. In Cantonese, there are six tones and each word also has only one syllable. Other languages with tones include That language, Vietnamese, and so on.

In an aspect, the lyric-note correlation can relate to algorithmic composition of a melody according to lyrics expressed in any number of languages. Given a lyric written in a language with different tones, a melody composer called T-Music also referred to as "the system", can leverage the lyric-note correlation for melody composition. There are two phases in the system. The first phase is a preprocessing phase which first finds lyric-note correlations based on a database or data store that stores numerous existing songs each of which involve both the song's melody and the song's lyric by performing a frequent pattern mining task of the song data stored at the data store. In an aspect, the songs identified via the frequent pattern mining task are identified based on the lyric-note correlations and can be used to, build a Probabilistic Automaton (herein referred to as "PA"). The second phase is a melody composition phase which generates a melody given a lyric by executing the PA generated in the first phase. In various embodiments, the system can access a robust knowledge source for melody composition in that the system utilizes not only an existing song database (stored at the data store), but also utilizes the tone information of the given lyric. Second, the system is highly user-friendly wherein a user who does not have much knowledge about music and does not know how to choose a suitable melody composition algorithm can still generate a melody by using the system. Furthermore, the user can gain a personal and convenient experience by using the system, wherein a melody can often be generated automatically based on a lyric written by the user.

In an aspect, a song can be accompanied by song lyrics wherein the lyrics are a set of words. A set of song lyrics can be comprised of numerous lyric fragments also referred to as a subset of words (e.g., one or more words in a sequence). As illustrated in FIG. 1 each respective word can be comprised of various tones and accordingly each syllable of a word is associated with a respective tone (e.g., primary stress, secondary stress, or non-stress). For instance, let T be the total number of tones. In this system, each tone is associated with a tone identifier, also referred to as a tone ID$\in$[1, T]. For example, in the English language, there are three possible tones where 1, 2 and 3 can be used to represent the tone IDs for the primary stress, the secondary stress and the non-stress, respectively. In Mandarin, there are 4 or 5 tones, and in Cantonese, there are 6 tones.

Figure 2:
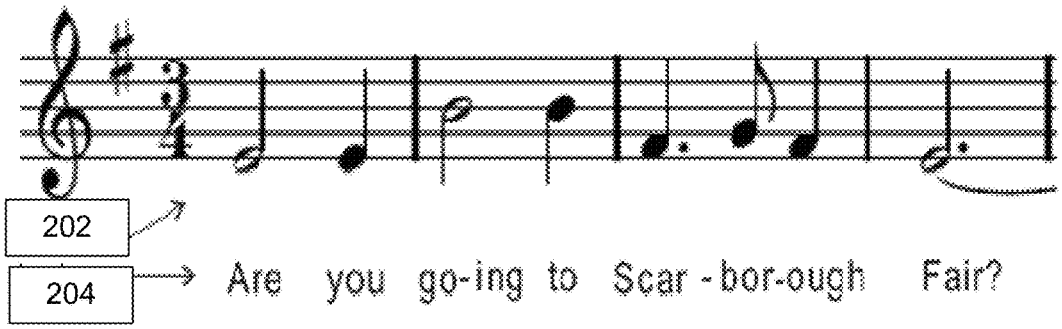
FIG. 2 illustrates a non-limiting example of a song lyric and a song melody.

Turning now to FIG. 2, illustrated are basic concepts in music theory. At 202, a segment of a melody is illustrated wherein the melody is represented by a sequence of notes, and at 204 a lyric is illustrated which is represented by a sequence of words. An entire song can comprise a set of lyrics and a set of notes, wherein the melody is represented by the set of notes in sequence. Each note is associated with a pitch, wherein the pitch denotes the frequency of the sound that corresponds with the note, and its duration of the sound (e.g., the interval of time of the sound). In an aspect, a note can be characterized by a pitch and duration.

In an aspect, a lyric, illustrated at 204, is defined as a sequence of words and each word is comprised of one or more syllables. Furthermore, in an aspect, each syllable is associated with a tone ID. Thus, each lyric can be represented by a sequence of tone IDs for the lyric. By combining the melody representation and the lyric representation, a song can be represented in the form of a sequence of 2-tuples each in the form of (note, tone ID). The song representation can be referred to as an s-sequence. In an aspect, a specific (note, tone ID)-pair, can be referred to as p.note (e.g., the note element) and as p.tone (e.g., the tone element).

Figure 3:
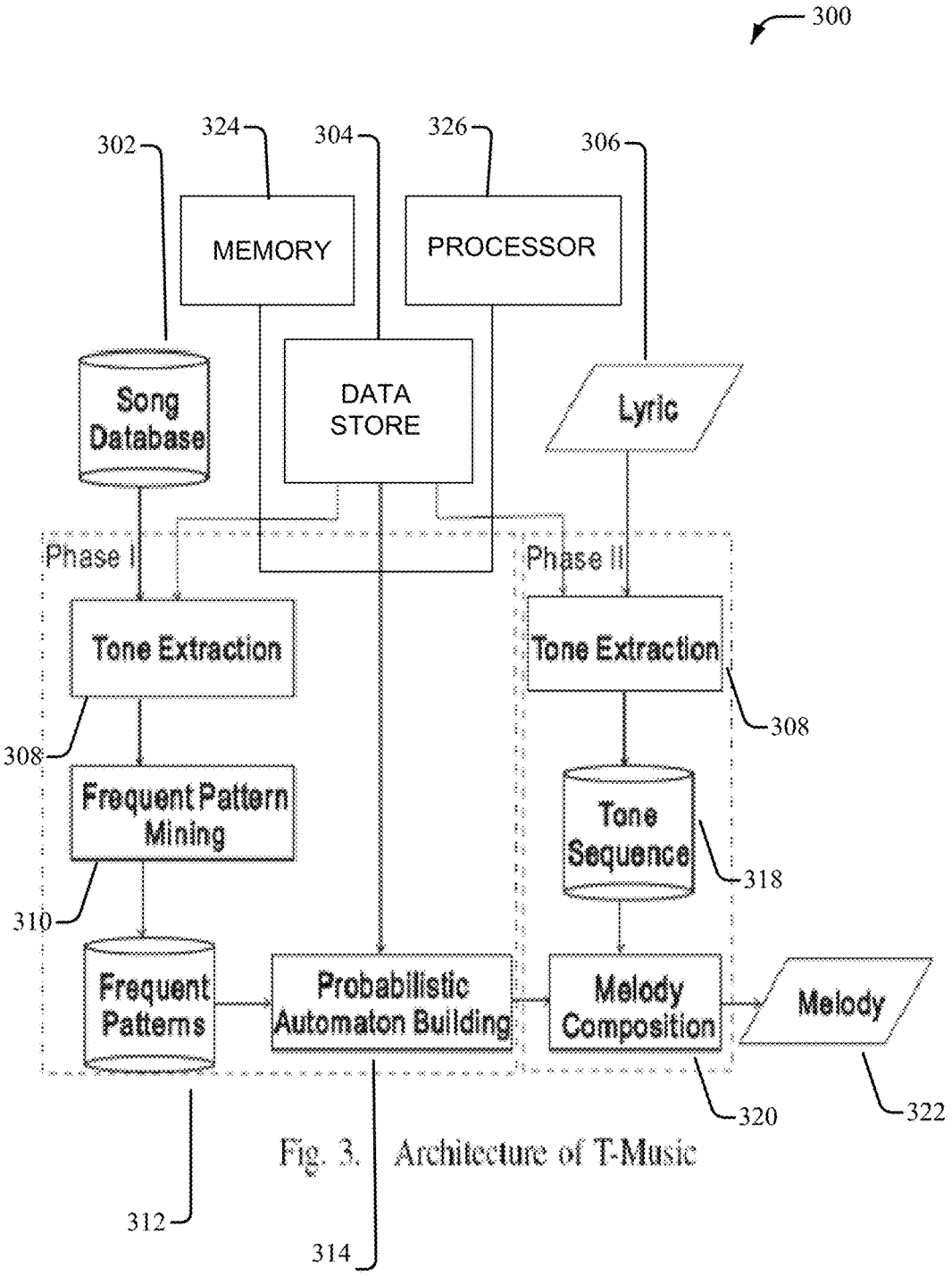
FIG. 3 illustrates an non-limiting example of a system for generating a melody based on the lyric-note correlation between the notes and lyrics of a song.

Turning now to FIG. 3, illustrated is a system presenting the architecture of T-Music. Illustrated at FIG. 3 is system 300 comprising various components including a memory 324 having stored thereon computer executable components, and a processor 326 configured to execute computer executable components stored in the memory. In an aspect, a song database 302 stores songs and data associated with such songs. The system 300 is comprised of a Phase I subsystem that employs tone extraction component 308, frequent pattern mining component 310, frequent patterns 312, and probabilistic automaton building component 314. In an aspect, data store 304 stores tone data, data values, tone look-up tables that comprise mapping between the syllable of each word and the tone ID. For each song of a set of songs stored at the song database and each lyric associated with a respective song, system 300 employs tone extraction component 308 to extract tone data. Furthermore, in an aspect, tone extraction component 308 identifies the tone sequence and thus the s-sequence for each respective song. In another aspect, frequent pattern mining component 310 determines the frequent patterns 312 associated with the set of songs based on the identified s-sequences. In an aspect, the frequent patterns 312 correspond to the lyric-note correlation. In another aspect, system 300 also employs probabilistic automaton building component 314 that builds a Probabilistic Automaton (PA) based on the frequent patterns 312.

In another aspect, system 300 is comprised of a Phase II subsystem, wherein the data store 304, lyric input component 306, tone extraction component 308, tone sequence component 318, and melody composition component 320 are components employed by the Phase II subsystem. In an aspect, the memory 324, data store 304, and processor 326 are employed by both Phase I and Phase II subsystems. The lyric input component 306 can store a set of lyrics representing a variety of languages. In an aspect, system 300, via tone extraction component 308 extracts the tone sequence from one or more lyrics received from lyric input component 306. In another aspect, system 300 employs melody composition component 320 that generates a melody based on the PA and the extracted tone sequence.

In yet another aspect, system 300 employs frequent pattern mining component 310 that determines the frequent patterns 312 associated with the set of songs based on the identified s-sequences. The act of frequent pattern mining can be described using representations. Let D be the set of s-sequences corresponding to the songs stored at the song database component 302. Let S be a s-sequence. The length of S, is denoted by |S|, to be the number of (note, tone ID)-pairs in S. In an aspect, S[i, j] represents the s-sequence comprising (note, tone ID)-pairs which occur between the $i^{th}$ position and the $j^{th}$ position in S. For example, S[1,m] corresponds to S itself, where m is the length of S. Given two s-sequences $S=((n_1, t_1), \ldots, (n_m, t_m))$ and $S'=((n'_1, t'_1), \ldots, (n'_{m'}, C_{m'}))$, the concatenation between S and S', is denoted by $S \diamond S'$, which is defined as the s-sequence of $((n_1, t_1), \ldots, (n_m, t_m), (n'_1, t'_1), \ldots, (n'_{m'}, t'_{m'}))$. In an aspect, S' is referred to a sub-string of S if there exists an integer i such that S[i, i+m'−1] is exactly S', where m' is the length of S'. It is defined that a support of a s-sequence S wrt D to the number of s-sequences in D that have S as its sub-string. Given a threshold δ, the frequent pattern mining component 310 identifies s-sequences S with its support wrt D at least δ. An algorithm is adopted for finding frequent sub-sequence/substring mining. For each frequent s-sequence S, its support is maintained, denoted by S.T.

Turning now to FIG. 4, illustrated is another aspect of system 300 wherein system 300 employs probabilistic automaton building component 314 that builds a Probabilistic Automaton (PA) based on the frequent patterns 312. In an aspect, Probabilistic Automaton (PA) is a generalization of Non-deterministic Finite Automaton (NFA). NFA is designed for lexical analysis in automata theory. Formally, NFA can be represented by a 5-tuple $(Q, \Sigma, \Delta, q_0, F)$, where (1) Q is a finite set of states, (2) Σ is a set of input symbols, (3) Δ is a transition relation $Q \times \Sigma \rightarrow P(Q)$, where P(Q) denotes the power set of Q, (4) $q_0$ is the initial state and (5) $F \subseteq Q$ is the set of final (accepting) states. PA generalizes NFA in a way such that the transitions in PA happen with probabilities. Besides, the initial state $q_0$ in NFA, which is deterministic, is replaced in PA with a probability vector v each of which entries corresponds to the probability that the initial state is equal to a state in Q. Thus, we represent a PA with a 5-tuple (Q, Σ, Δ, v, F), where Q, Σ and F have the same meanings as their counterparts in an NFA, and each transition in Δ is associated with a probability.

Let T be the sequence of tone IDs extracted from the received lyric. An example of the sequence (called the tone sequence) can be (2, 1, 3, 5) (Illustrated at the first row 420 in FIG. 4(B)). In the following, the probabilistic automaton building act performed by probabilistic automaton building component 314 is described wherein a PA is constructed that is represented by (Q, Σ, Δ, v, F). In an aspect, Q is constructed to be the set containing s-sequences S that satisfy the following two conditions: (a) S has its length equal to 1, where 1 is a user given parameter and (b) $\exists S' \in D$ such that S is a sub-string of S'. In another aspect, Σ is constructed to be the set containing tone IDs. In another aspect, Δ is constructed as follows: Δ is initially to be ∅. Then, for each pair of a state $q \in Q$ and a symbol $t \in \Sigma$, the following two steps are performed. First, a set of states are found, denoted by $Q_{q,t}$, such that each state q' in $Q_{q,t}$ satisfies the following: (1) q'[1:1−1] is exactly the same as q[2:1] and (2) q'[1].tone is exactly the same as t.

Second, for each state $q' \in Q_{q,t}$, created in A is a transition from q to q' with the input of t and set its probability to be $q'.T/\Sigma_{q'' \in Q_{q,t}} q''.T$. In an aspect, for each state $q \in Q$, The probability that the initial state is q is set to be $q.T/\Sigma_{q \in Q} q.T$. In yet another aspect, F is constructed as ∅. This is because the termination of the execution on the PA in the melody composition is not indicated by the final states. Instead, it terminates after tone IDs in T have been inputted, where T is the sequence of tones extracted from the input lyric.

Figures 4A, 4B:
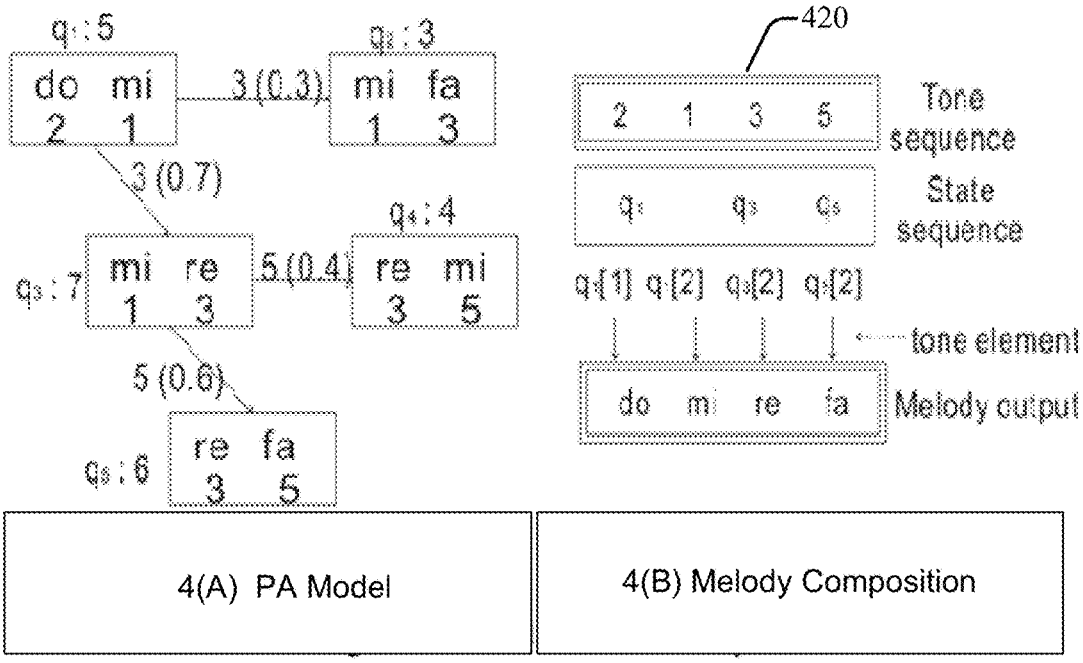
FIG. 4A illustrates an example non-limiting probabilistic automaton in connection with generating a song melody.
FIG. 4B illustrates an example non-limiting tone input data sequence in connection with generating a song melody.

Turning now to FIG. 4(A) presented is an instance of a PA. In the figure, omitted is the duration for simplicity. There are 5 states, $q_1$, $q_2$, $q_3$, $q_4$, $q_5$, each represented by a box. The number next to each state is the support of its corresponding s-sequence, e.g., $q_1.T=5$. The arrow from a state to another means a transition and the number along the arrow is the input symbol in Σ corresponding to the transition. Besides, the number within the parentheses is the probability associated with the corresponding transition. In an aspect, system 300 generates a melody via melody composition component 320. In an aspect, melody composition component 320 generates a melody by executing the PA constructed by the probabilistic automaton building component 314 with the input of the tone sequence extracted from the input lyric, i.e., T. Specifically, let $(q_1, q_2, \ldots, q_n)$ be the sequence of resulting states when executing the PA with T as the input. Then, the melody generated by system 300, which is a sequence of notes, is represented by $(q_1[1].note, q_1[2].note, \ldots, q_1[1].note) \diamond (q_2[1].note) \diamond (q_3[1].note) \ldots, \diamond (q_n[1].note)$. Note that $q_1[2:1]$ is exactly the same as $q_{1+1}[1:1-1]$ since there exists a transition from $q_i$ to $q_{i+1}$ in Δ for $1 \leq i \leq n-1$.

Specifically, during the execution process on the PA, the following scenario might occur. There exist no transitions from the current state, says q, to other states with the current input tone ID, says t, i.e., Δ(q, t) is an ∅. Thus, in this case, the execution process cannot proceed. To fix this issue, in system 300, select the state q' in Q such that (1) q'[1:1−1] is the most similar to q[2:1], (2) q'[1].tone is exactly the same as t and (3) Δ(q', t) is non-empty. The similarity measurement adopted in system 300 is the common edit distance measurement between two strings. In an aspect, melody composition component 320 executes the PA as illustrated in FIG. 4(A) with the input of the tone sequence as shown in FIG. 4(B). Suppose it chooses state $q_1$ as the initial state.

After that, the current state is $q_1$ and the current input symbol is 3 (tone IDs 2 and 1 are involved in state $q_1$). At this moment, the next state could be either $q_2$ (with the probability equal to 0.3) or $q_3$ (with the probability equal to 0.7). Suppose it proceeds at state $q_3$. Now, the current input symbol is 5. Further assume that it chooses $q_5$ as the next state. Since the tone IDs in the tone sequence have been inputted, the execution process stops. As a result, the sequence of resulting states is ($q_1$, $q_3$, $q_5$) and thus the melody generated is ($q_1$[1].note, $q_1$[2].note, $q_3$[2].note, $q_5$[2].note), which is simply (do, mi, re, fa) with the duration information.

In an aspect, some advanced concepts related to music theory were considered for melody composition using system 300. For instance, the harmony rule, rhythm, coherence, and vocal range concepts were considered with respect to system 300. Two examples of harmony rules are the chord progression and the cadence. Each song can be broken down into phases. We can regard a phase as a sentence in a language. In music theory, each phase ends with a cadence. A cadence is a certain kind of patterns which describe the ending of a phase. It is just like a full-stop or a comma in English. According to the concept of cadence, the last few notes at the end of each phase must come from some particular notes. In an aspect, system 300 can generate notes at the end of each phase according to this cadence principle. In particular, when notes are generated at the end of a phase, the notes related to the cadence are considered instead of all possible notes.

Regarding rhythm, rhythm can be used for generating the melody. For example, the last note of a phase should be longer. The rhythm of a phase is similar to the rhythm of some of the other phases. With respect to coherence, in a song, one part in the melody is usually similar to the other part so that the song has a coherence effect. In an aspect, system 300 can also incorporate this concept. Specifically, whenever another phase for the melody is generated, it is investigated as to whether some portions of the melody generated previously can be used to generate the new portions of the melody to be composed automatically. If yes, some existing portions of the melody are used for the new portions. The criterion requires investigation as to whether each existing portion of the melody together with the portion of the lyric can be found in the frequent patterns mined in Phase 1. Regarding vocal range, some vocal ranges, such as those of a human, are considered bounded (e.g., at most two octaves). The vocal range is the measure of the breadth of pitches that a human voice can sing. Based on the vocal range, system 300 can restrict the possible choices of notes to be generated whenever it executes the PA.

Figure 5:
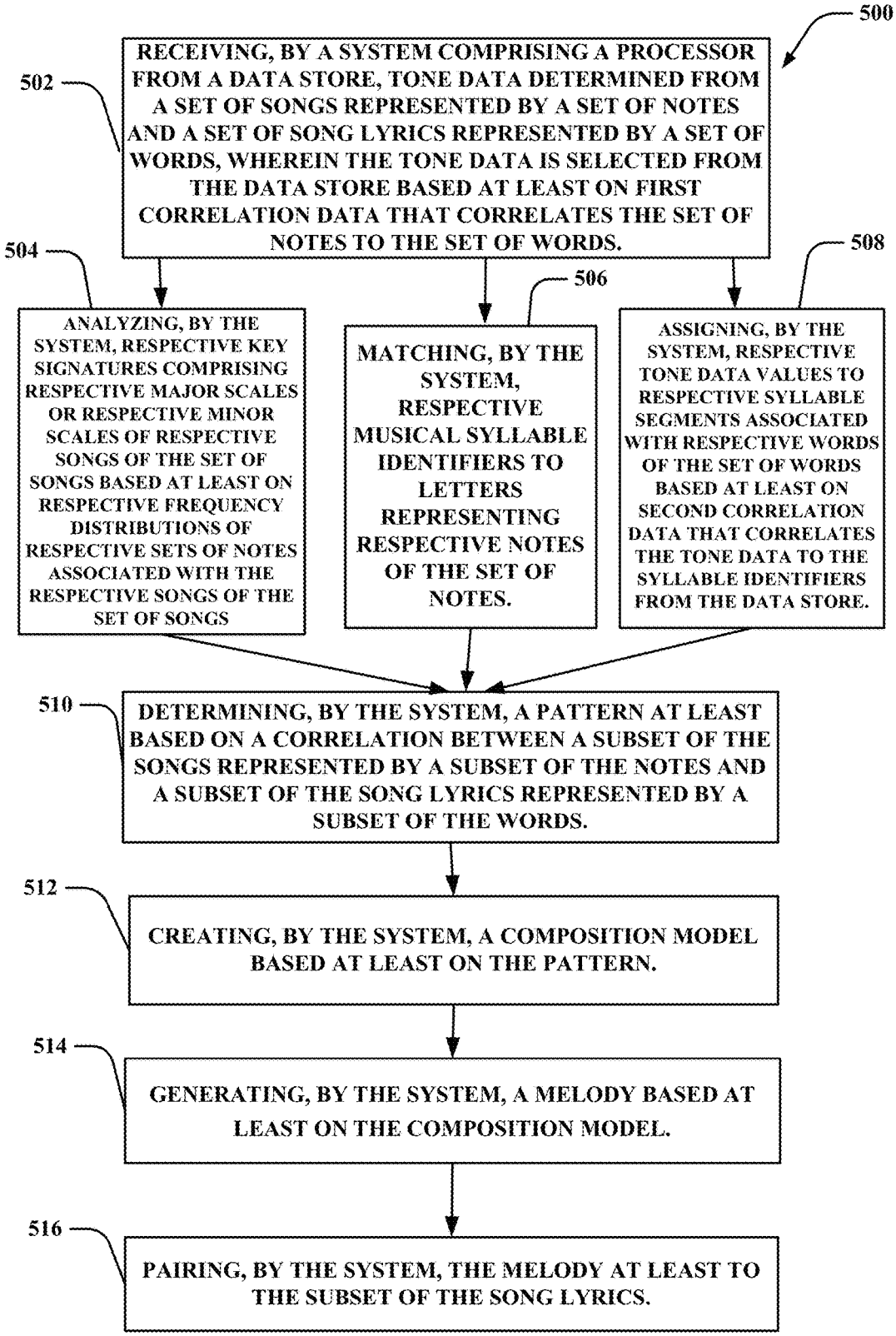
FIG. 5 illustrates an non-limiting example method for generating a melody in connection with a set of song lyrics and a set of notes.
Figure 6:
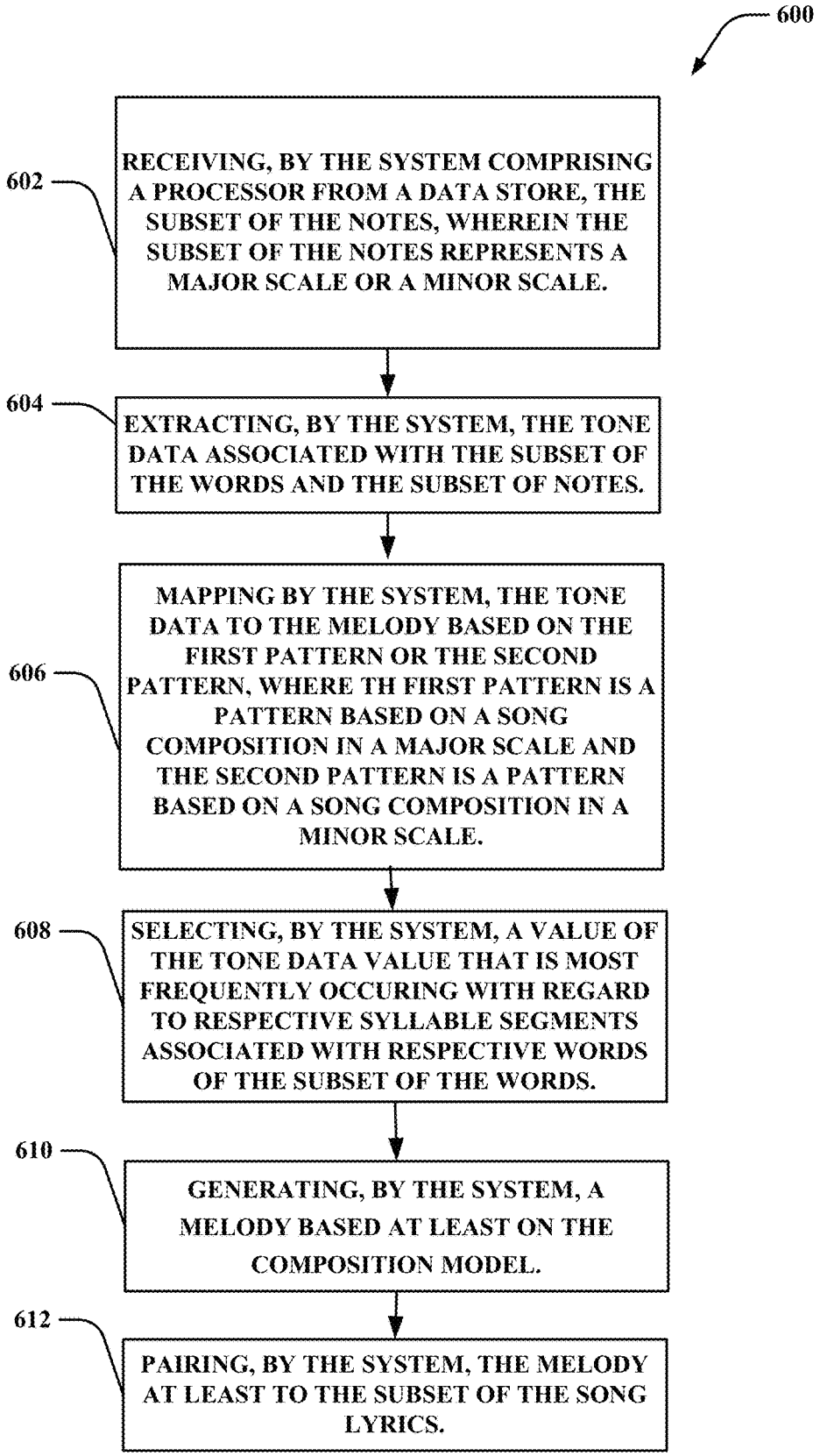
FIG. 6 illustrates an non-limiting example method for generating a melody in connection with a set of song lyrics and a set of notes.

Turning now to FIGS. 5 and 6, illustrated are methodologies or flow diagrams in accordance with certain aspects of this disclosure. While, for purposes of simplicity of explanation, the disclosed methods are shown and described as a series of acts, the disclosed subject matter is not limited by the order of acts, as some acts may occur in different orders and/or concurrently with other acts from that shown and described herein. For example, those skilled in the art will understand and appreciate that a methodology can alternatively be represented as a series of interrelated states or events, such as in a state diagram. Moreover, not all illustrated acts may be required to implement a method in accordance with the disclosed subject matter. Additionally, it is to be appreciated that the methodologies disclosed in this disclosure are capable of being stored on an article of manufacture to facilitate transporting and transferring such methodologies to computers or other computing devices.

Referring now to FIG. 5, presented is a flow diagram of an example application of systems disclosed in this description in accordance with an embodiment. In an aspect, exemplary method 500 of the disclosed systems is stored in a memory and utilizes a processor to execute computer executable instructions to perform functions. At 502, tone data is received, by a system comprising a processor from a data store, wherein the tone data is deter mined from a set of songs represented by a set of notes and a set of song lyrics represented by a set of words, wherein the tone data is selected from the data store based at least on first correlation data that correlates the set of notes to the set of words. At 504, the system analyzes, respective key signatures comprising respective major scales or respective minor scales of respective songs of the set of songs based at least on respective frequency distributions of respective sets of notes associated with the respective songs of the set of songs. At 506, the system matches respective musical syllable identifiers to letters representing respective nots of the set of notes. At 508, the system assigns respective tone data values to respective syllable segments associated with respective words of the set of words based at least on second correlation data that correlates the tone data to the syllable identifiers from the data store. At 510, a pattern is determined by the system, wherein the pattern is at least based on a correlation between a subset of the songs represented by a subset of the notes and a subset of the song lyrics represented by a subset of the words. At 512, a composition model based at least on the pattern is created by the system. In an aspect, the pattern is a sequence of two-tuples, wherein a first tuple element is a note comprising a pitch and duration, a second tuple element is a tone identifier, and the sequence of two-tuples is represented as an association of the note and the note identifier. At 514, a melody based at least on the composition model is generated by the system. At 516, the system pairs the melody at least to the subset of the song lyrics. In an aspect, the pairing comprises pairing the melody to the set of song lyrics.

Referring now to FIG. 6, presented is a flow diagram of an example application of systems disclosed in this description in accordance with an embodiment. In an aspect, exemplary method 600 of the disclosed systems is stored in a memory and utilizes a processor to execute computer executable instructions to perform functions. At 602, the system, comprising a processor, receives from a data store, the subset of the notes, wherein the subset of the notes represents a major scale or a minor scale. At 604, the system extracts tone data associated with the subset of the words and the subset of notes. At 606, the system, maps the tone data to the melody based on the first pattern or the second pattern, where the first pattern is a pattern based on a song composition in a major scale and the second pattern is a pattern based on a song composition in a minor scale. At 608, the system selects a value of the tone data value that is most frequently occurring with regard to respective syllable segments associated with respective words of the subset of the words. At 610, a melody based at least on the composition model is generated by the system. In an aspect, the composition model is a probabilistic model based on at least one of the pattern, the first pattern, or the second pattern. At 612, the system pairs the melody at least to the subset of the song lyrics. In an aspect, the pairing comprises pairing the melody to the set of song lyrics.

In view of the exemplary systems described above, methodologies that may be implemented in accordance with the described subject matter will be better appreciated with reference to the flowcharts of the various figures. While for purposes of simplicity of explanation, the methodologies are shown and described as a series of blocks, it is to be understood and appreciated that the claimed subject matter is not limited by the order of the blocks, as some blocks may occur in different orders and/or concurrently with other blocks from what is depicted and described in this disclosure. Where non-sequential, or branched, flow is illustrated via flowchart, it can be appreciated that various other branches, flow paths, and orders of the blocks, may be implemented which achieve the same or a similar result. Moreover, not all illustrated blocks may be required to implement the methodologies described hereinafter.

In addition to the various embodiments described in this disclosure, it is to be understood that other similar embodiments can be used or modifications and additions can be made to the described embodiment(s) for performing the same or equivalent function of the corresponding embodiment(s) without deviating there from. Still further, multiple processing chips or multiple devices can share the performance of one or more functions described in this disclosure, and similarly, storage can be effected across a plurality of devices. Accordingly, the invention is not to be limited to any single embodiment, but rather can be construed in breadth, spirit and scope in accordance with the appended claims.

Example Operating Environments

The systems and processes described below can be embodied within hardware, such as a single integrated circuit (IC) chip, multiple ICs, an application specific integrated circuit (ASIC), or the like. Further, the order in which some or all of the process blocks appear in each process should not be deemed limiting. Rather, it should be understood that some of the process blocks can be executed in a variety of orders, not all of which may be explicitly illustrated in this disclosure.

Figure 7:
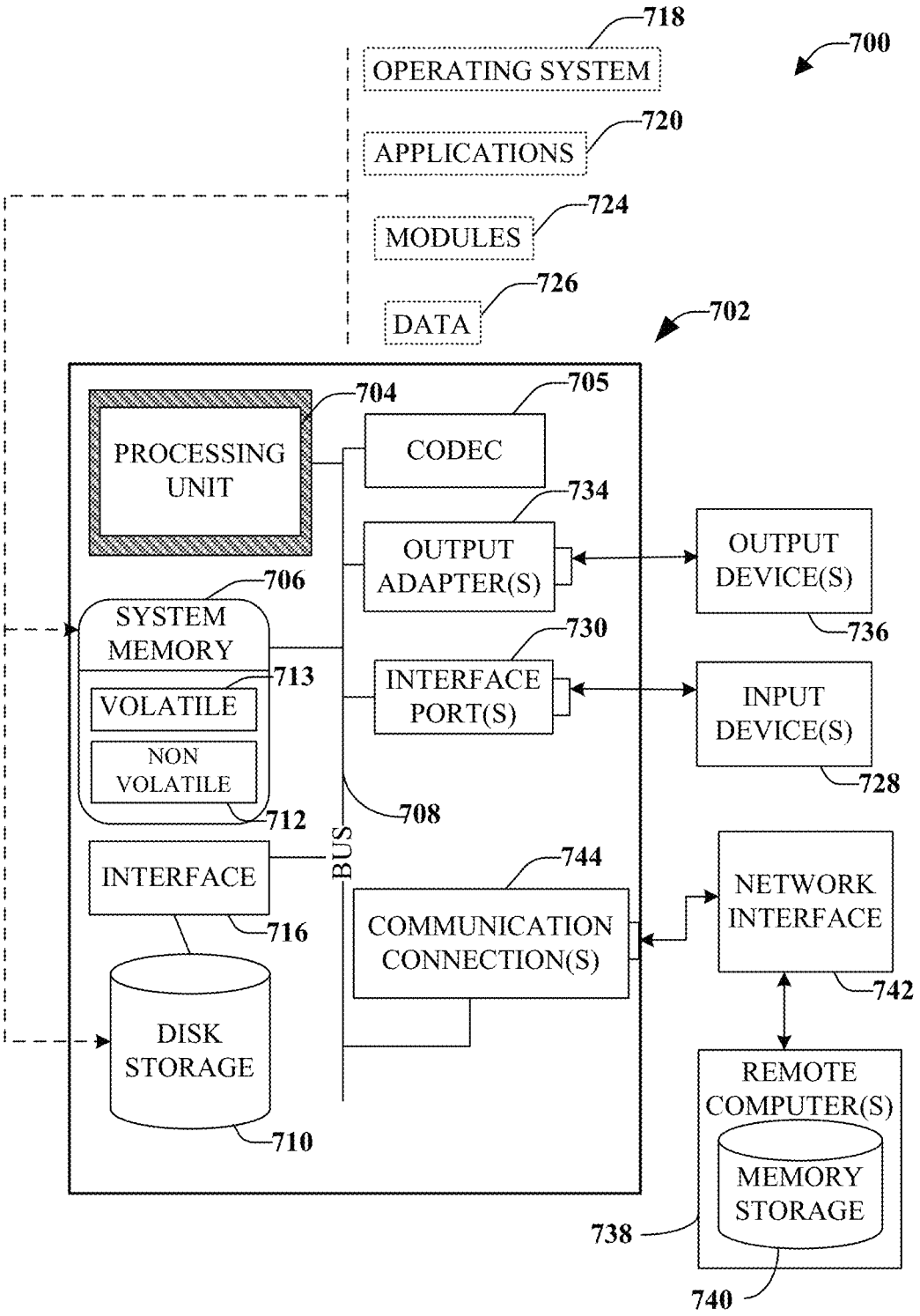
FIG. 7 is a block diagram representing an exemplary non-limiting networked environment in which the various embodiments can be implemented.

With reference to FIG. 7, a suitable environment 700 for implementing various aspects of the claimed subject matter includes a computer 702. The computer 702 includes a processing unit 704, a system memory 706, a codec 705, and a system bus 708. The system bus 708 couples system components including, but not limited to, the system memory 706 to the processing unit 704. The processing unit 704 can be any of various available processors. Dual microprocessors and other multiprocessor architectures also can be employed as the processing unit 704.

The system bus 708 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI).

The system memory 706 includes volatile memory 713 and non-volatile memory 712. The basic input/output system (BIOS), containing the basic routines to transfer information between elements within the computer 702, such as during start-up, is stored in non-volatile memory 712. In addition, according to various embodiments, codec 705 may include at least one of an encoder or decoder, wherein the at least one of an encoder or decoder may consist of hardware, a combination of hardware and software, or software. Although, codec 705 is depicted as a separate component, codec 705 may be contained within non-volatile memory 712. By way of illustration, and not limitation, non-volatile memory 712 can include read only memory (ROM), programmable ROM (PROM), electrically programmable ROM (EPROM), electrically erasable programmable ROM (EEPROM), or flash memory. Volatile memory 713 includes random access memory (RAM), which acts as external cache memory. According to present aspects, the volatile memory may store the write operation retry logic (not shown in FIG. 7) and the like. By way of illustration and not limitation, RAM is available in many forms such as static RAM (SRAM), dynamic RAM (DRAM), synchronous DRAM (SDRAM), double data rate SDRAM (DDR SDRAM), and enhanced SDRAM (ESDRAM).

Computer 702 may also include removable/non-removable, volatile/non-volatile computer storage medium. FIG. 7 illustrates, for example, disk storage 710. Disk storage 710 includes, but is not limited to, devices like a magnetic disk drive, solid state disk (SSD) floppy disk drive, tape drive, Jaz drive, Zip drive, LS-70 drive, flash memory card, or memory stick. In addition, disk storage 710 can include storage medium separately or in combination with other storage medium including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 710 to the system bus 708, a removable or non-removable interface is typically used, such as interface 716.

It is to be appreciated that FIG. 7 describes software that acts as an intermediary between users and the basic computer resources described in the suitable operating environment 700. Such software includes an operating system 718. Operating system 718, which can be stored on disk storage 710, acts to control and allocate resources of the computer system 702. Applications 720 take advantage of the management of resources by the operating system through program modules 724, and program data 726, such as the boot/shutdown transaction table and the like, stored either in system memory 706 or on disk storage 710. It is to be appreciated that the claimed subject matter can be implemented with various operating systems or combinations of operating systems.

A user enters commands or information into the computer 702 through input device(s) 728. Input devices 728 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 704 through the system bus 708 via interface port(s) 730. Interface port(s) 730 include, for example, a serial port, a parallel port, a game port, and a universal serial bus (USB). Output device(s) 736 use some of the same type of ports as input device(s) 728. Thus, for example, a USB port may be used to provide input to computer 702, and to output information from computer 702 to an output device 736. Output adapter 734 is provided to illustrate that there are some output devices 736 like monitors, speakers, and printers, among other output devices 736, which require special adapters. The output adapters 734 include, by way of illustration and not limitation, video and sound cards that provide a means of connection between the output device 736 and the system bus 708. It should be noted that other devices and/or systems of devices provide both input and output capabilities such as remote computer(s) 738.

Computer 702 can operate in a networked environment using logical connections to one or more remote computers, such as remote computer(s) 738. The remote computer(s) 738 can be a personal computer, a server, a router, a network PC, a workstation, a microprocessor based appliance, a peer device, a smart phone, a tablet, or other network node, and typically includes many of the elements described relative to computer 702. For purposes of brevity, only a memory storage device 740 is illustrated with remote computer(s) 738. Remote computer(s) 738 is logically connected to computer 702 through a network interface 742 and then connected via communication connection(s) 744. Network interface 742 encompasses wire and/or wireless communication networks such as local-area networks (LAN) and wide-area networks (WAN) and cellular networks. LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 744 refers to the hardware/software employed to connect the network interface 742 to the bus 708. While communication connection 744 is shown for illustrative clarity inside computer 702, it can also be external to computer 702. The hardware/software necessary for connection to the network interface 742 includes, for exemplary purposes only, internal and external technologies such as, modems including regular telephone grade modems, cable modems and DSL modems, ISDN adapters, and wired and wireless Ethernet cards, hubs, and routers.

Figure 8:
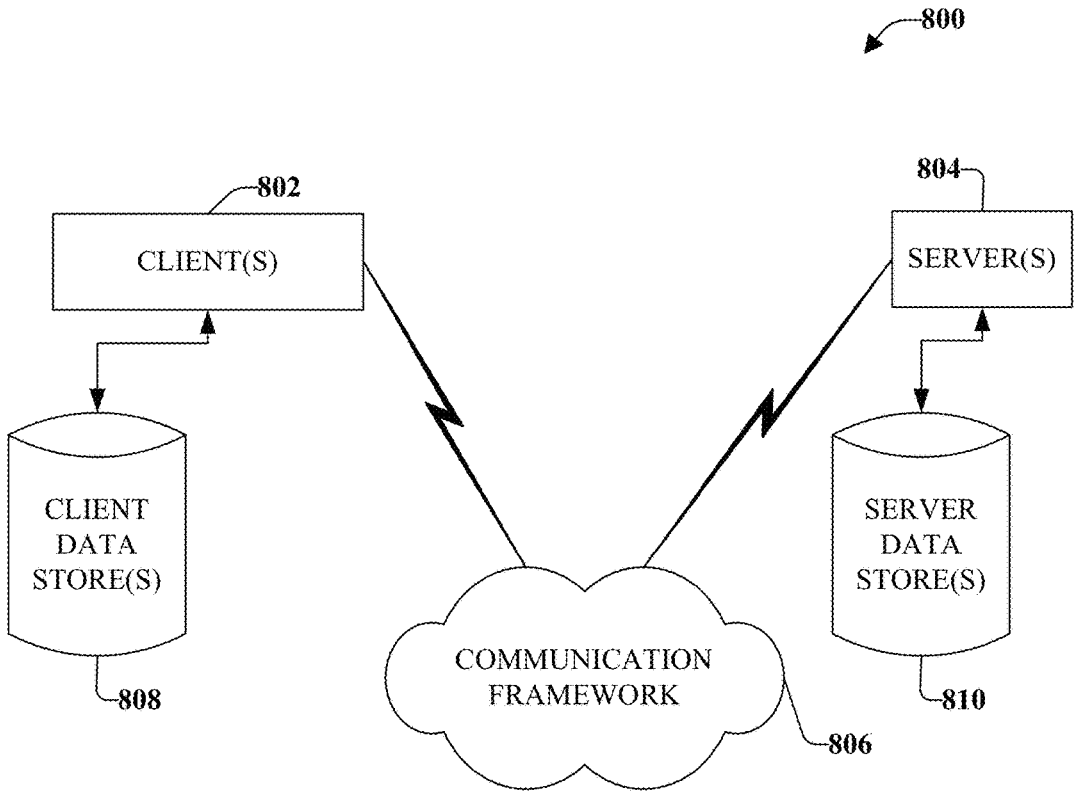
FIG. 8 is a block diagram representing an exemplary non-limiting computing system or operating environment in which the various embodiments may be implemented.

Referring now to FIG. 8, there is illustrated a schematic block diagram of a computing environment 800 in accordance with this disclosure. The system 800 includes one or more client(s) 802 (e.g., laptops, smart phones, PDAs, media players, computers, portable electronic devices, tablets, and the like). The client(s) 802 can be hardware and/or software (e.g., threads, processes, computing devices). The system 800 also includes one or more server(s) 804. The server(s) 804 can also be hardware or hardware in combination with software (e.g., threads, processes, computing devices). The servers 804 can house threads to perform transformations by employing aspects of this disclosure, for example. One possible communication between a client 802 and a server 804 can be in the form of a data packet transmitted between two or more computer processes wherein the data packet may include video data. The data packet can include a metadata, such as associated contextual information for example. The system 800 includes a communication framework 806 (e.g., a global communication network such as the Internet, or mobile network(s)) that can be employed to facilitate communications between the client(s) 802 and the server(s) 804.

Communications can be facilitated via a wired (including optical fiber) and/or wireless technology. The client(s) 802 include or are operatively connected to one or more client data store(s) 808 that can be employed to store information local to the client(s) 802 (e.g., associated contextual information). Similarly, the server(s) 804 are operatively include or are operatively connected to one or more server data store(s) 810 that can be employed to store information local to the servers 804.

In one embodiment, a client 802 can transfer an encoded file, in accordance with the disclosed subject matter, to server 804. Server 804 can store the file, decode the file, or transmit the file to another client 802. It is to be appreciated, that a client 802 can also transfer uncompressed file to a server 804 and server 804 can compress the file in accordance with the disclosed subject matter. Likewise, server 804 can encode video information and transmit the information via communication framework 806 to one or more clients 802.

The illustrated aspects of the disclosure may also be practiced in distributed computing environments where certain tasks are performed by remote processing devices that are linked through a communications network. In a distributed computing environment, program modules can be located in both local and remote memory storage devices.

Moreover, it is to be appreciated that various components described in this description can include electrical circuit(s) that can include components and circuitry elements of suitable value in order to implement the various embodiments. Furthermore, it can be appreciated that many of the various components can be implemented on one or more integrated circuit (IC) chips. For example, in one embodiment, a set of components can be implemented in a single IC chip. In other embodiments, one or more of respective components are fabricated or implemented on separate IC chips.

What has been described above includes examples of the embodiments of the present invention. It is, of course, not possible to describe every conceivable combination of components or methodologies for purposes of describing the claimed subject matter, but it is to be appreciated that many further combinations and permutations of the various embodiments are possible. Accordingly, the claimed subject matter is intended to embrace all such alterations, modifications, and variations that fall within the spirit and scope of the appended claims. Moreover, the above description of illustrated embodiments of the subject disclosure, including what is described in the Abstract, is not intended to be exhaustive or to limit the disclosed embodiments to the precise forms disclosed. While specific embodiments and examples are described in this disclosure for illustrative purposes, various modifications are possible that are considered within the scope of such embodiments and examples, as those skilled in the relevant art can recognize.

In particular and in regard to the various functions performed by the above described components, devices, circuits, systems and the like, the terms used to describe such components are intended to correspond, unless otherwise indicated, to any component which performs the specified function of the described component (e.g., a functional equivalent), even though not structurally equivalent to the disclosed structure, which performs the function in the disclosure illustrated exemplary aspects of the claimed subject matter. In this regard, it will also be recognized that the various embodiments include a system as well as a computer-readable storage medium having computer-executable instructions for performing the acts and/or events of the various methods of the claimed subject matter.

The aforementioned systems/circuits/modules have been described with respect to interaction between several components/blocks. It can be appreciated that such systems/circuits and components/blocks can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described in this disclosure may also interact with one or more other components not specifically described in this disclosure but known by those of skill in the art.

In addition, while a particular feature of the various embodiments may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

As used in this application, the terms "component," "module," "system," or the like are generally intended to refer to a computer-related entity, either hardware (e.g., a circuit), a combination of hardware and software, software, or an entity related to an operational machine with one or more specific functionalities. For example, a component may be, but is not limited to being, a process running on a processor (e.g., digital signal processor), a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers. Further, a "device" can come in the form of specially designed hardware; generalized hardware made specialized by the execution of software thereon that enables the hardware to perform specific function; software stored on a computer readable storage medium; software transmitted on a computer readable transmission medium; or a combination thereof.

Moreover, the words "example" or "exemplary" are used in this disclosure to mean serving as an example, instance, or illustration. Any aspect or design described in this disclosure as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Computing devices typically include a variety of media, which can include computer-readable storage media and/or communications media, in which these two terms are used in this description differently from one another as follows. Computer-readable storage media can be any available storage media that can be accessed by the computer, is typically of a non-transitory nature, and can include both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

On the other hand, communications media typically embody computer-readable instructions, data structures, program modules or other structured or unstructured data in a data signal that can be transitory such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

In view of the exemplary systems described above, methodologies that may be implemented in accordance with the described subject matter will be better appreciated with reference to the flowcharts of the various figures. For simplicity of explanation, the methodologies are depicted and described as a series of acts. However, acts in accordance with this disclosure can occur in various orders and/or concurrently, and with other acts not presented and described in this disclosure. Furthermore, not all illustrated acts may be required to implement the methodologies in accordance with certain aspects of this disclosure. In addition, those skilled in the art will understand and appreciate that the methodologies could alternatively be represented as a series of interrelated states via a state diagram or events. Additionally, it should be appreciated that the methodologies disclosed in this disclosure are capable of being stored on an article of manufacture to facilitate transporting and transferring such methodologies to computing devices. The term article of manufacture, as used in this disclosure, is intended to encompass a computer program accessible from any computer-readable device or storage media.

What is claimed is:

1. A method, comprising:

mapping, by a system comprising a processor, a set of song lyrics to a first set of tone data, wherein the set of song lyrics is represented by a set of words comprising a set of syllables that correspond to a first melody, wherein the first melody is represented by a set of notes that correspond to a first set of pitch data, wherein the set of song lyrics and mapped to the first set of tone data are stored in a data store, and wherein the set of notes correspond to the set of words;

determining, by the system, a correlation corresponding to a co-occurrence pattern between a first sequence of tones of the first set of tone data corresponding to a subset of syllables of the set of syllables and a first sequence of pitches of the first set of pitch data corresponding to a subset of notes of the set of notes;

creating, by the system, a composition model based on the co-occurrence pattern, wherein the co-occurrence pattern facilitates a creation of a second melody based on a set of user submitted song lyrics;

extracting, by the system, a second set of tone data from a first subset of user submitted song lyrics of the set of user submitted song lyrics; and generating, by the system, a second melody corresponding to the first subset of user submitted song lyrics based at least on the composition model as applied to the first subset of user submitted song lyrics, the co-occurrence pattern and the second set of tone data.

2. The method of claim 1, further comprising pairing, by the system, the second melody to the first subset of user submitted song lyrics.

3. The method of claim 1, further comprising analyzing, by the system, a key signature comprising a major scale or a minor scale of a song based at least on a frequency distribution of a subset of notes associated with a melody.

4. The method of claim 1, further comprising matching, by the system, respective musical syllable identifiers to letters representing respective notes of the set of notes.

5. The method of claim 4, wherein the respective musical syllable identifiers include Do, Re, Mi, Fa, So, La, or Ti.

6. The method of claim 1, further comprising assigning, by the system, respective tone data values of the first sequence of tones to respective syllable segments associated with respective words of the set of words.

7. The method of claim 1, wherein the pattern is a sequence of two-tuples, wherein a first tuple element is a note comprising a pitch and a sound duration, a second tuple element is a tone identifier, and wherein the sequence of two-tuples is represented by an association of the note and the tone identifier.

8. The method of claim 7, wherein the pitch represents a frequency of a sound and the sound duration represents a duration of the sound.

9. The method of claim 1, further comprising, performing, by the system, pattern mining to determine the pattern.

10. The method of claim 1, wherein the pattern comprises a first pattern based on a song composition in a major scale and a second pattern based on a song composition in a minor scale.

11. The method of claim 1, wherein the composition model is a probabilistic model based on at least one of the co-occurrence pattern, a first pattern, or a second pattern.

12. The method of claim 1, further comprising:

receiving, by the system, a subset of words of the set of words and the subset of notes, wherein the subset of notes represents a major scale or a minor scale;

extracting, by the system, a subset of tone data associated with the subset of words and the subset of notes; and mapping, by the system, the subset of tone data to the second melody based on a first pattern or a second pattern.

13. The method of claim 12, further comprising selecting, by the system, a pitch value corresponding to the first set of pitch data that is most frequently occurring with regard to respective syllable segments associated with respective words of the subset of words.

14. The method of claim 1, wherein the composition model comprises information representing at least one of a harmonic variable, a cadence variable, a vocal range variable, or a data correlation between a first subset of words of the set of words and a second subset of words of the set of words.

15. A system, comprising:

a processor, coupled to a memory, that executes one or more executable components, comprising:

a first tone extraction component that maps a first set of tone data to a set of syllables of a set of words, wherein a set of song lyrics corresponding to a first melody comprising a set of notes, further a comprises the set of words, and wherein the mapping is based on the set of syllables corresponding to a first set of tone sequences of the first set of tone data;

a song database that stores the set of song lyrics having the set of syllables mapped to the first set of tone data;

a pattern mining component that determines a pattern at least based on a correlation representing a co-occurrence between a first set of pitch sequences of a set of pitches within a first subset of notes of the set of notes and the first set of tone sequences;

an automatic modeling component that creates an automatic composition model based on the pattern, wherein the automatic composition model facilitates creation of a second melody based on a set of user submitted song lyrics;

a second tone extraction component, that extracts a second set of tone data comprising a second set of tone sequences from the set of user submitted song lyrics; and a generation component that generates the second melody corresponding to the set of user submitted song lyrics based on the automatic composition model and the second set of tone sequences as applied to the user submitted song lyrics.

16. The system of claim 15, wherein the one or more executable components further comprise an analysis component that analyzes a key signature comprising a major scale or a minor scale of a song at least based on a frequency distribution of a second subset of notes of a melody.

17. The system of claim 15, wherein the one or more executable components further comprise a matching component that matches syllable identifiers associated with letters that represent notes of the set of notes.

18. The system of claim 15, wherein the one or more executable components further comprise an assignment component that assigns respective tone data values of the first set of tone sequences to respective syllables of respective words of the set of words.

19. The system of claim 15, wherein the pattern is a sequence of two-tuples, comprising a first tuple element that is a note identifier of a note comprising a pitch and a duration and a second tuple element that is a tone identifier, and wherein the sequence of two-tuples is represented as an association of the note and the tone identifier.

20. The system of claim 19, wherein a pitch of the set of pitches represents a frequency of a sound and a duration of the sound represented as a temporal length of the sound.

21. A system, comprising a processor, coupled to a memory, that executes or facilitates execution of executable instructions to perform operations, the executable instructions comprising:

a song database that stores a set of song lyrics mapped to a first set of tone data comprising a first sequence of tones, wherein the set of song lyrics are represented by a set of words comprising a set of syllables, wherein the set of song lyrics correspond to a first melody comprising a set of notes, and wherein the first set of tone data is mapped to the set of song lyrics based on a subset of syllables that corresponds to a first subsequence of tones of the first sequence of tones;

a frequent pattern mining component that identifies a pattern at least based on first correlation data that correlates a co-occurrence of a first sequence of pitches within a subset of notes of the set of notes and the first sequence of tones, and wherein the first sequence of pitches correspond to the first melody;

a probabilistic automaton component that builds a probabilistic composition model based on the pattern, wherein the probabilistic composition model facilitates creation of a second sequence of pitches based on a set of user submitted song lyrics;

a tone extraction component that extracts a second set of tone data comprising a second sequence of tones from the set of user submitted song lyrics; and a melody composition component that generates a second sequence of pitches that corresponds to a second melody based on the probabilistic composition model, the user submitted song lyrics, and the second sequence of tones.

22. The system of claim 21, wherein the executable instructions further comprise a lyric input component that receives the set of user submitted song lyrics.

* * * * *